US011873829B2

(12) United States Patent
Wang et al.

(10) Patent No.: US 11,873,829 B2
(45) Date of Patent: Jan. 16, 2024

(54) FAN BLADE SUPPORT ASSEMBLY FOR FAN BLADE, AIR DUCT ASSEMBLY AND AIR CONDITIONER

(71) Applicant: Gree Electric Appliances, Inc. of Zhuhai, Guangdong (CN)

(72) Inventors: Chunjie Wang, Guangdong (CN); Pan Yang, Guangdong (CN); Weiquan Yu, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 776 days.

(21) Appl. No.: 16/969,865

(22) PCT Filed: Dec. 11, 2018

(86) PCT No.: PCT/CN2018/120373
§ 371 (c)(1),
(2) Date: Aug. 13, 2020

(87) PCT Pub. No.: WO2019/174336
PCT Pub. Date: Sep. 19, 2019

(65) Prior Publication Data

US 2021/0062818 A1 Mar. 4, 2021

(30) Foreign Application Priority Data

Mar. 15, 2018 (CN) ..... 201810215360.1

(51) Int. Cl.
*F04D 29/054* (2006.01)
*F24F 13/20* (2006.01)
(Continued)

(52) U.S. Cl.
CPC ..... *F04D 29/044* (2013.01); *F04D 29/054* (2013.01); *F24F 13/10* (2013.01); *F24F 13/20* (2013.01); *F24F 13/24* (2013.01)

(58) Field of Classification Search
CPC ..... F04D 17/16; F04D 29/044; F04D 29/052; F04D 29/053; F04D 29/054; F24F 1/0022; F24F 1/0025
See application file for complete search history.

(56) References Cited

FOREIGN PATENT DOCUMENTS

CN 107525246 A 12/2017
CN 206771671 U 12/2017
(Continued)

OTHER PUBLICATIONS

Machine translation of CN 107525246, Yang et al., published Dec. 29, 2017 (Year: 2017).*
(Continued)

*Primary Examiner* — David E Sosnowski
*Assistant Examiner* — Jason G Davis
(74) *Attorney, Agent, or Firm* — McAndrews, Held & Malloy, Ltd.

(57) ABSTRACT

Some embodiments of the present disclosure provide a fan blade support assembly for a fan blade, an air duct assembly, and an air conditioner. The fan blade support assembly includes: a support base, the support base includes a support base body, and the support base body is provided with a support base hole; a support structure, provided in the support base hole, and the support structure is provided with a shaft hole; and a fan blade shaft, an end of the fan blade shaft is connected to a drive portion after passing through the shaft hole, and the fan blade shaft is movably provided relative to the support base, wherein, the fan blade shaft includes a first shaft section and a second shaft section connected with the first shaft section, and a diameter of the first shaft section is less than a diameter of the second shaft section.

16 Claims, 4 Drawing Sheets

(51) Int. Cl.

| | |
|---|---|
| ***F24F 13/24*** | (2006.01) |
| ***F04D 29/044*** | (2006.01) |
| ***F24F 13/10*** | (2006.01) |

(56) References Cited

FOREIGN PATENT DOCUMENTS

| | | | | |
|---|---|---|---|---|
| CN | 107676946 | A | 2/2018 | |
| CN | 208012025 | U | 10/2018 | |
| EP | 3006856 | A2 * | 4/2016 | ..... F24F 1/0025 |
| JP | H09145077 | A | 6/1997 | |
| JP | H10 300115 | A | 11/1998 | |
| JP | H10300115 | A | 11/1998 | |
| JP | 2009 250114 | A | 10/2009 | |

OTHER PUBLICATIONS

International Search Report, dated Mar. 13, 2019, in International application No. PCT/ CN2018/120373, with a filing date of Dec. 11, 2018.

The extended European search report for Application No. 18910081.1, dated Mar. 17, 2021, European Patent Office, Germany (8 pages).

* cited by examiner

FAN BLADE SUPPORT ASSEMBLY FOR FAN BLADE, AIR DUCT ASSEMBLY AND AIR CONDITIONER

CROSS-REFERENCE TO RELATED APPLICATION(S)

The present disclosure is a national stage application of International Patent Application No. PCT/CN2018/120373, filed on Dec. 11, 2018 and claims priority to Chinese Patent Application No. 201810215360.1, filed on Mar. 15, 2018 and entitled "Fan Blade Support Assembly for Fan Blade, Air Duct Assembly and Air Conditioner," the contents of which are hereby incorporated by reference in its entirety.

TECHNICAL FIELD

The present disclosure relates to a field of air conditioners, and in particular to a fan blade support assembly for a fan blade, an air duct assembly, and an air conditioner.

BACKGROUND

In a fan blade of an air conditioner in an art known to inventors, a motor shaft is extended into an axial hole of a fan blade shaft of the fan blade, and a fastening screw is tightened from an outside of the fan blade shaft, so that the fastening screw is abutted against an outer wall surface of the motor shaft, in this way, the motor shaft can drive the fan blade shaft to be rotated. An outer wall surface of the fan blade shaft is provided with a support part for supporting the fan blade shaft, and the support part is provided with a shaft hole through which the fan blade shaft passes. Because there is not a gap between the shaft hole of the support part and the outer wall surface of the fan blade shaft, while a motor drives the fan blade shaft to be rotated, friction and collision happen between the outer wall surface of the fan blade shaft and an inner wall surface of the shaft hole of the support part, so an abnormal sound is made while the motor drives the fan blade shaft to be rotated. That is, the air conditioner in the art known to inventors makes the abnormal sound due to the friction and collision while the fan blade is rotated.

SUMMARY

Some embodiments of the present disclosure provide a fan blade support assembly for a fan blade, an air duct assembly, and an air conditioner, so as to solve a problem in an art known to inventors that the air conditioner makes an abnormal sound due to friction and collision while the fan blade is rotated.

Some embodiments of the present disclosure provide a fan blade support assembly for a fan blade, the fan blade support assembly includes: a support base, the support base includes a support base body, and the support base body is provided with a support base hole; a support structure, provided in the support base hole, and the support structure is provided with a shaft hole; and a fan blade shaft, an end of the fan blade shaft is connected with a drive portion after passing through the shaft hole, and the fan blade shaft is movably provided relative to the support base, wherein, the fan blade shaft includes a first shaft section and a second shaft section connected with the first shaft section, and a diameter of the first shaft section is less than a diameter of the second shaft section.

In some embodiments, the fan blade shaft is provided with a first position which can be driven by the drive portion and a second position separated from the drive portion, when the fan blade shaft is positioned in the first position, there is a gap between an outer wall surface of the first shaft section and an inner wall surface of the shaft hole, and when the fan blade shaft is positioned in the second position, the second shaft section is abutted against the inner wall surface of the shaft hole.

In some embodiments, the fan blade shaft further includes a transition section disposed between the first shaft section and the second shaft section, from the first shaft section to the second shaft section, an outer diameter of the transition section is gradually increased.

In some embodiments, the fan blade shaft further includes the transition section disposed between the first shaft section and the second shaft section, from the first shaft section to the second shaft section, an outer diameter of the transition section is gradually increased, the fan blade shaft is provided with a first position and a second position, when the fan blade shaft is positioned in the first position, there is the gap between an outer wall surface of the first shaft section and an inner wall surface of the shaft hole; and when the fan blade shaft is positioned in the second position, the transition section is abutted against the inner wall surface of the shaft hole.

In some embodiments, the support structure is a sleeve provided at an outer circumference of the fan blade shaft in a sleeving manner, an internal through hole of the sleeve forms the shaft hole, and the sleeve is an elastic part.

Some embodiments of the present disclosure provide an air duct assembly, the air duct assembly includes an installing base, and the air duct assembly further includes the above fan blade support assembly installed on the installing base and a fan blade connected with the fan blade shaft.

In some embodiments, the air duct assembly further includes the drive portion, the fan blade shaft is provided with the first position and the second position, when the fan blade shaft is positioned in the first position, the fan blade shaft can be driven by the drive portion; and when the fan blade shaft is positioned in the second position, the fan blade shaft is separated from the drive portion.

In some embodiments, the fan blade shaft is provided with an axial hole, a motor shaft of the drive portion is inserted into the axial hole, so as to connect the drive portion and the fan blade shaft.

In some embodiments, the axial hole passes through the first shaft section and the second shaft section.

In some embodiments, the fan blade shaft is further provided with a radial hole communicated with the axial hole, the air duct assembly further includes a locking part, the locking part passes through the radial hole and abuts against the motor shaft, so that the motor shaft is locked on the fan blade shaft.

In some embodiments, the radial hole is opened in the second shaft section.

Some embodiments of the present disclosure provide an air conditioner, and the air conditioner includes a housing and an air duct assembly installed in the housing, the air duct assembly is the above air duct assembly.

In some embodiments of the present disclosure, the fan blade support assembly is applied to the air duct assembly of the air conditioner, and the fan blade support assembly is adopted, when the fan blade shaft is connected with the drive portion, the first shaft section of the fan blade shaft is disposed in the shaft hole of the support structure. Because the diameter of the first shaft section is less than a diameter of the second shaft section, and the fan blade shaft is moveably provided relative to the support base, when the fan blade shaft is connected with the drive portion, there is the gap between the outer wall surface of the first shaft section of the fan blade shaft and the inner wall surface of the shaft hole of the support structure, in this way, when the drive portion drives the fan blade shaft to be rotated, the mutual friction or collision, caused by tiny shaft runout, between the outer wall surface of the fan blade shaft and the inner wall surface of the shaft hole of the support structure is avoided, thereby the noise is reduced, and the problem in the art known to inventors that the abnormal sound and noise are caused by the friction or collision between the fan blade shaft and the support structure is solved. In addition, the fan blade support assembly in some embodiments can prevent the fan blade shaft from being worn.

BRIEF DESCRIPTION OF THE DRAWINGS

The drawings of the description forming a part of the present disclosure are used to provide further understanding to the present disclosure, schematic embodiments of the present disclosure and descriptions thereof are used to explain the present disclosure, and do not form improper limitation to the present disclosure. In the drawings.

Figure 1:
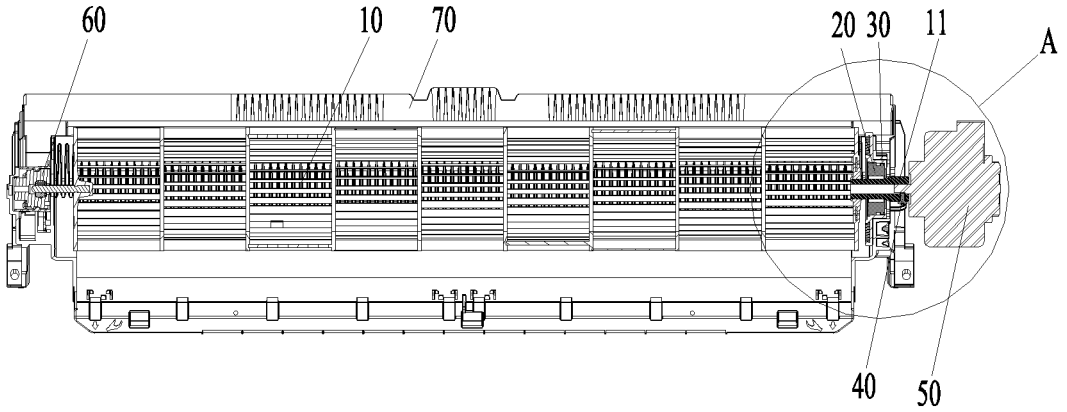
FIG. 1 shows a section view (herein a drive portion is shown) of an air duct assembly according to some embodiments of the present disclosure.

Herein, the above drawings include the following reference signs: 10, Fan blade; 11, Fan blade shaft; 111, First shaft section; 112, Second shaft section; 113, Transition section; 114, Axial hole; 115, Radial hole; 20, Support structure; 21, Shaft hole; 30, Support base; 40, Locking part; 50, Drive portion; 60, Installing shaft sleeve; and 70, Installing base.

DETAILED DESCRIPTION OF THE EMBODIMENTS

It is to be noted that embodiments in the present disclosure and features in the embodiments are mutually combined without confliction. The present disclosure is described in detail below with reference to the drawings and in combination with the embodiments.

In the art known to inventors, the fan blade shaft is in locking-connection with the motor shaft of the drive portion, and after the motor shaft is connected with the fan blade shaft, there is not the support structure around, that is, there is a gap radially disposed between an outer wall surface of the fan blade shaft and the installing base, that is, the fan blade shaft is located in a suspension state. In the air conditioner based on such setting, while the fan blade is assembled, the fan blade shaft is required to be aligned to the motor shaft, only in this way, the fan blade shaft is in locking-connection with the motor shaft of the drive portion. However, in the air conditioner, the fan blade shaft and the motor shaft are shielded by an evaporator, an angle of view of the fan blade shaft and the motor shaft is very small to an operator, so the difficulty of aligning the fan blade shaft and the motor shaft is increased. That is, in the art known to inventors, it is difficult to be aligned while the fan blade shaft and the motor shaft are assembled, so the operation is difficult, the assembly efficiency is low, and the alignment accuracy is lower. In order to solve the above problem in the art known to inventors, the following embodiments are provided by the inventor.

Embodiment 1

As shown in FIG. 1 to FIG. 6, an embodiment of the present disclosure provides a fan blade support assembly for a fan blade. The fan blade support assembly in Embodiment 1 includes a support base 30, a support structure 20 and a fan blade shaft 11; the support base 30 includes a support base body, and the support base body is provided with a support base hole; the support structure 20 is installed in the support base hole, and the support structure 20 is provided with a shaft hole 21; one end of the fan blade shaft 11 is connected with a drive portion 50 after passing through the shaft hole 21, and the fan blade shaft 11 is moveably installed relative to the support base 30, wherein, the fan blade shaft 11 includes a first shaft section 111 and a second shaft section 112 connected with the first shaft section 111, and a diameter of the first shaft section 111 is less than a diameter of the second shaft section 112.

In embodiment 1, the fan blade support assembly is applied to an air duct assembly of an air conditioner, while the fan blade support assembly is adopted, and the fan blade shaft 11 is connected with the drive portion 50, the first shaft section 111 of the fan blade shaft 11 is disposed in a shaft hole 21 of the support structure 20. Because the diameter of the first shaft section 111 is less than that of the second shaft section 112, and the fan blade shaft 11 is moveably provided relative to the support base 30, while the fan blade shaft 11 is connected with the drive portion 50, there is a gap between an outer wall surface of the first shaft section 111 of the fan blade shaft 11 and an inner wall surface of the shaft hole 21 of the support structure 20, in this way, while the drive portion 50 drives the fan blade shaft 11 to be rotated, the mutual friction or collision, caused by tiny shaft runout, between the outer wall surface of the fan blade shaft 11 and the inner wall surface of the shaft hole 21 of the support structure 20 is avoided, thereby a noise is reduced, and the problem in the art known to inventors that the abnormal sound and noise are caused by the friction between the fan blade shaft and the support structure is solved. Further, because the friction is smaller, the fan blade support assembly in the above setting prevents the fan blade shaft 11 from being worn.

As shown in FIG. 1 to FIG. 6, in Some embodiments, the fan blade shaft 11 is provided with a first position which is driven by the drive portion 50 and a second position separated from the drive portion 50, when the fan blade shaft 11 is positioned in the first position, there is a gap between an outer wall surface of the first shaft section 111 and an inner wall surface of the shaft hole 21, and when the fan blade shaft 11 is positioned in the second position, the second shaft section 112 is abutted against the inner wall surface of the shaft hole 21.

In some embodiments, the fan blade support assembly is applied to the air duct assembly of the air conditioner. When the air conditioner is located in a normal working state, the fan blade shaft 11 is positioned in the first position, and the drive portion 50 drives the fan blade shaft 11 to be rotated. When the fan blade 10 and the fan blade support assembly are required to be detached from the air conditioner, in an axis direction of the shaft hole 21, the fan blade 10 is moved towards a direction away from the drive portion 50, so the fan blade shaft 11 is switched from the first position to the second position, that is, the fan blade shaft 11 is separated from the drive portion 50, in this way, the fan blade 10 and the fan blade support assembly are detached.

In some embodiments, the fan blade support assembly and the fan blade 10 are assembled together, as a modularized structure. In the embodiments, the fan blade 10 is connected with the fan blade shaft 11, when the fan blade shaft 11 is positioned in the second position, the outer wall surface of the second shaft section 112 is abutted against the inner wall surface of the shaft hole 21. In this way, the support structure 20 limits the fan blade shaft 11 to be moved in a radial direction of the shaft hole 21, thereby in a process of detaching the fan blade 10 and the fan blade support assembly, the fan blade shaft 11 does not move along the radial direction of the shaft hole 21 relative to the support base 30. While the fan blade 10 and the fan blade support assembly are required to be installed in the air conditioner, because the fan blade shaft 11 do not move along the radial direction of the shaft hole 21 relative to the support base 30, after the fan blade 10 and the fan blade support assembly are installed in the air conditioner, a position in which an axis of the fan blade shaft 11 is positioned is not changed relative to the position before detaching, that is, the fan blade shaft 11 and the motor shaft of the drive portion 50 have a same axis at this moment. At this moment, in an axis direction of the shaft hole 21, the fan blade 10 is moved towards a direction of the drive portion 50, that is, the fan blade shaft 11 is connected with the drive portion 50, in this process, due to the support effect of the support structure 20, an operator does not need to hold the fan blade shaft 11 by hands so as to align the fan blade shaft 11 and the drive portion 50, therefore, the technical solutions in some embodiments are convenient in operation, and higher in assembly efficiency. In this way, the embodiments are capable of, in the case of blind assembling, achieving a function that the fan blade shaft 11 is automatically aligned to the motor shaft of the drive portion 50, and the centering accuracy is higher.

Figure 5:
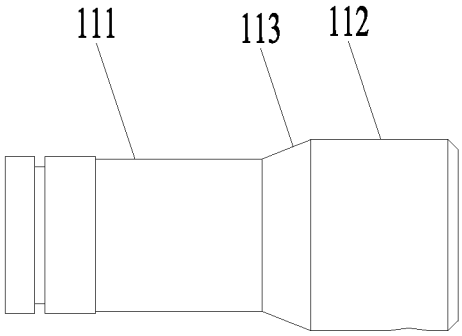
FIG. 5 shows a front view of a fan blade shaft of the air duct assembly in FIG. 1.
Figure 6:
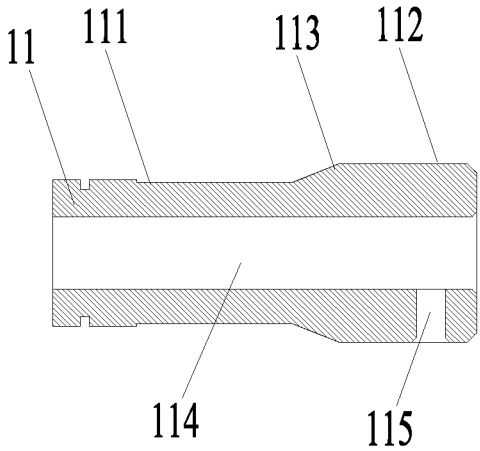
FIG. 6 shows a section view of the fan blade shaft in FIG. 5.

As shown in FIG. 5 and FIG. 6, in some embodiments, the fan blade shaft 11 further includes a transition section 113 disposed between the first shaft section 111 and the second shaft section 112, from the first shaft section 111 to the second shaft section 112, an outer diameter of the transition section 113 is gradually increased.

In some embodiments, the transition section 113 is disposed between the first shaft section 111 and the second shaft section 112. From the first shaft section 111 to the second shaft section 112, the outer diameter of the transition section 113 is gradually increased, so there is a smooth transition between the first shaft section 111 and the second shaft section 112. In a process of enabling the fan blade shaft 11 to be switched from the first position to the second position, a hole opening, towards the drive portion 50, of the shaft hole 21 of the support structure 20 is slided on a conical surface of the transition section 113, so that the fan blade shaft 11 is automatically centered in the process of switching from the first position to the second position relative to the axis of the shaft hole 21 of the support structure 20, that is, in the process of switching the fan blade shaft 11 from the first position to the second position, the position of the fan blade shaft 11 is automatically corrected by using the transition section 113 of the fan blade shaft 11.

In other words, in the process of switching the fan blade shaft 11 from the first position to the second position, the transition section 113 has the effect of centering and correcting. While the fan blade 10 and the fan blade support assembly are assembled in the air conditioner, the coaxiality between the fan blade shaft 11 of the assembled air conditioner and the motor shaft of the drive portion 50 is high, and axial runout caused by the deviation of a shaft center of the fan blade shaft 11 and a shaft center of the motor shaft is prevented during later operation, then the overall operation of the air conditioner and the service life thereof are affected.

Figure 3:
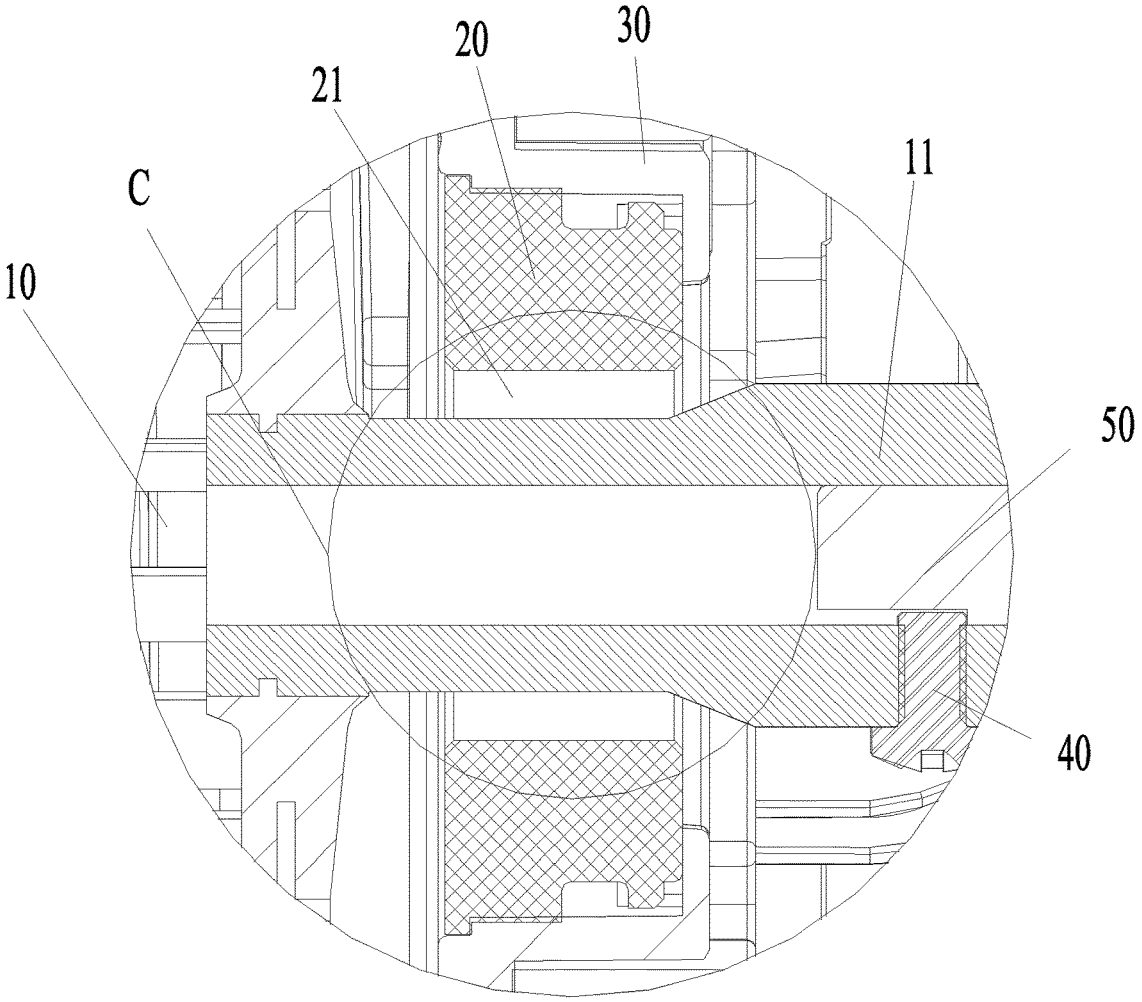
FIG. 3 shows an enlarged diagram of a place B in FIG. 2.
Figure 4:
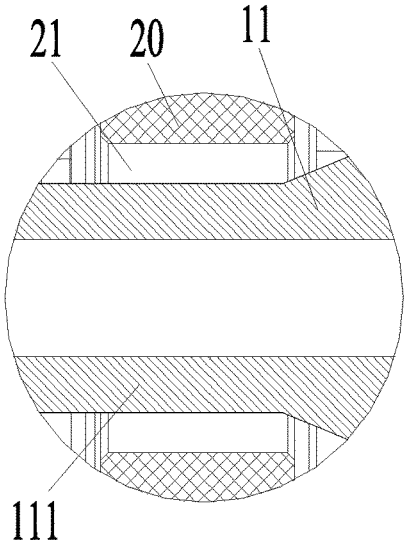
FIG. 4 shows an enlarged diagram of a place C in FIG. 3.

As shown in FIG. 3 and FIG. 4, in an embodiment, the support structure 20 is a sleeve provided at an outer circumference of the fan blade shaft 11 in a sleeving manner, an internal through hole of the sleeve forms the shaft hole 21, and the sleeve is an elastic part.

In some embodiments, the fan blade shaft 11 is connected with the drive portion 50 after passing through the internal through hole of the sleeve. In addition, when the fan blade shaft 11 is positioned in the second position, an inner wall surface of the sleeve is abutted against an outer wall surface of the second shaft section 112 of the fan blade shaft 11, thereby the fan blade shaft 11 is prevented from being moved along the radial direction of the internal through hole of the sleeve, it is convenient to assemble the fan blade shaft 11 and the motor shaft later. In the above setting, a contact area of the internal through hole of the sleeve and the fan blade shaft 11 is large, an acting area of the sleeve on the fan blade shaft 11 is large, the sleeve prevents the fan blade shaft 11 to be moved along the radial direction of the shaft hole 21 relative to the support base 30 better. In an embodiment, the sleeve is the elastic part, and good in abrasive resistance. In an embodiment, the sleeve is made of a rubber material, and small in weight.

Figure 2:
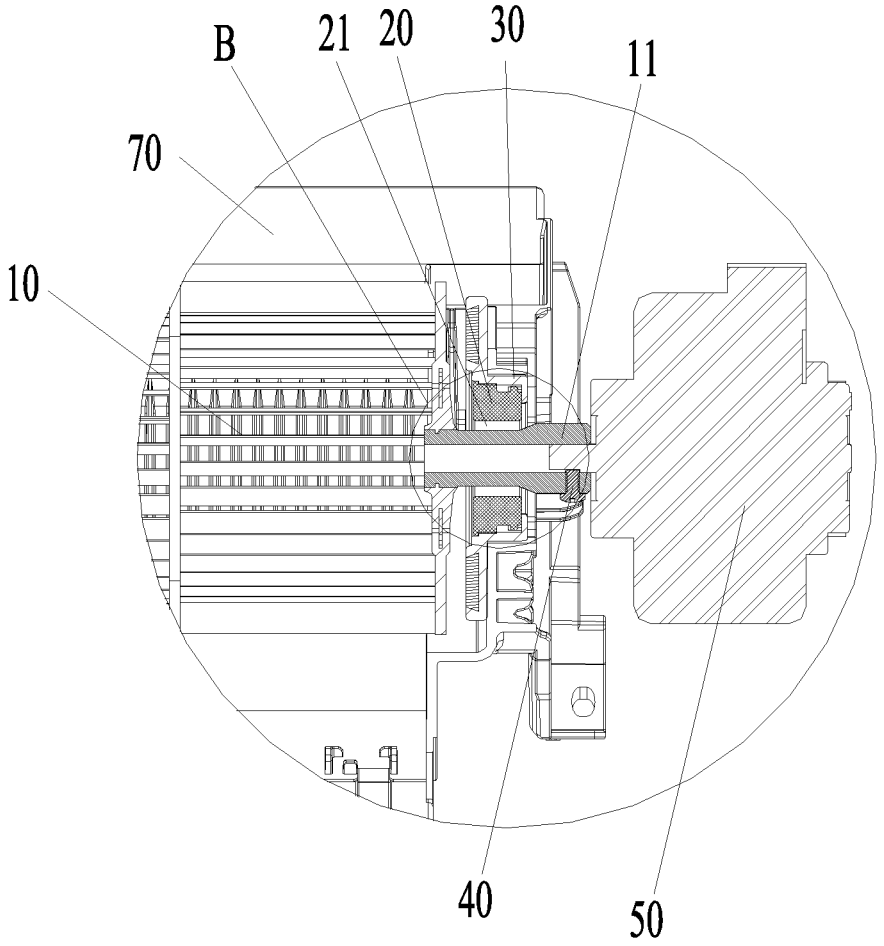
FIG. 2 shows an enlarged diagram of a place A in FIG. 1.

As shown in FIG. 1 and FIG. 2, some embodiments of the present disclosure provide an air duct assembly. The air duct assembly includes an installing base 70, the air duct assembly further includes a fan blade support assembly installed on the installing base 70 and a fan blade 10 connected with the fan blade shaft 11, the fan blade support assembly is the above fan blade support assembly.

In some embodiments, the fan blade support assembly and the fan blade 10 are installed on the installing base 70. In a process of enabling the air duct assembly to be detached from the air conditioner, when the fan blade 10 is moved in the axis direction of the shaft hole 21, the fan blade shaft 11 does not move in the radial direction of the shaft hole 21 relative to the support base 30. Therefore, while the air duct assembly is assembled in the air conditioner, a position in which an axis of the fan blade shaft 11 is positioned is not changed relative to the position before the air duct assembly is detached. At this moment, in the axis direction of the shaft hole 21 the fan blade 10 is moved towards a direction of the drive portion 50, that is, the fan blade shaft 11 can be connected with the drive portion 50, and the assembly is convenient.

Figure 7:
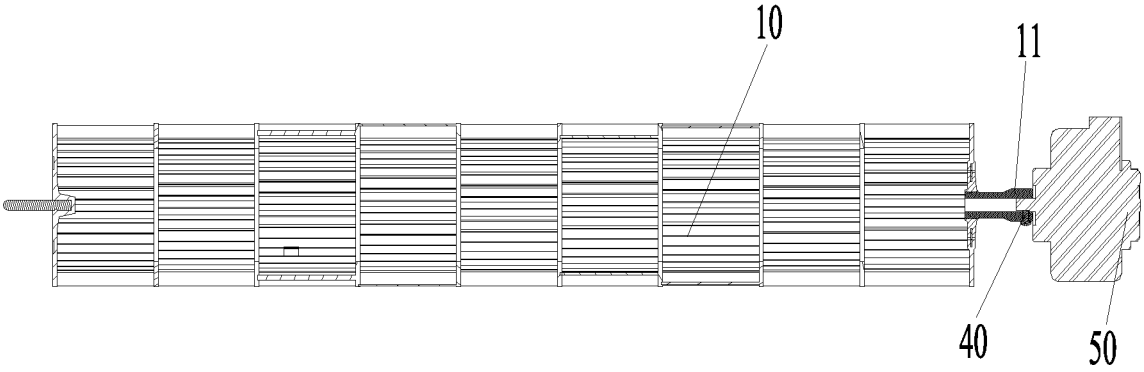
FIG. 7 shows a schematic diagram (herein the drive portion is shown, the fan blade shaft can be driven by the drive portion at this moment) when the fan blade shaft of the air duct assembly in FIG. 1 is positioned in a first position.
Figure 8:
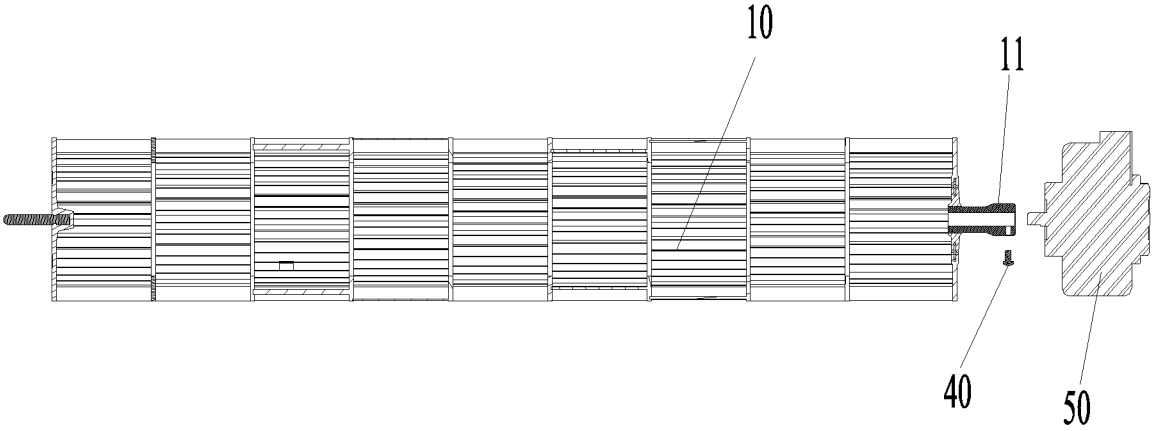
FIG. 8 shows a schematic diagram (herein the drive portion is shown, the fan blade shaft is separated from the drive portion at this moment) when the fan blade shaft of the air duct assembly in FIG. 1 is positioned in a second position.

As shown in FIG. 1, FIG. 7 and FIG. 8, in an embodiment, the air duct assembly further includes the drive portion 50, the fan blade shaft 11 is provided with the first position and the second position, when the fan blade shaft 11 is positioned in the first position, the fan blade shaft 11 is driven by the drive portion 50; and when the fan blade shaft 11 is positioned in the second position, the fan blade shaft 11 is separated from the drive portion 50.

In some embodiments, when the air conditioner is located in a normal working state, the fan blade shaft 11 is positioned in the first position, and the drive portion 50 drives the fan blade shaft 11 to be rotated. While the air duct assembly is required to be detached, and the follow-up maintenance or clean operation is performed, the fan blade shaft 11 is switched from the first position to the second position, at this moment, the fan blade shaft 11 is separated from the drive portion 50, that is, the air duct assembly is detached from the air conditioner.

As shown in FIG. 2, FIG. 3 and FIG. 6, in an embodiment, the fan blade shaft 11 is provided with an axial hole 114, the motor shaft of the drive portion 50 is inserted into the axial hole 114, so as to connect the drive portion 50 and the fan blade shaft 11.

In some embodiments, the motor shaft is inserted into the axial hole 114, that is, the drive portion 50 is connected with the fan blade shaft 11, the operation is simple. In addition, the fan blade shaft 11 and the motor shaft in the above setting are simple in structure, and it is convenient to achieve.

Certainly, in an embodiment which is not given in the drawings, an end face, towards the drive portion 50, of the fan blade shaft 11 is provided with a plurality of convex ribs, and an end face, towards the fan blade shaft 11, of the motor shaft is provided with a plurality of grooves corresponding to a plurality of the convex ribs one by one. When the fan blade shaft 11 is in the first position, the convex ribs are inserted into the corresponding grooves respectively, in this way, the drive portion 50 drives the fan blade shaft 11 to be rotated. When the fan blade shaft 11 is in the second position, the convex ribs are disconnected with the corresponding grooves, in this way, the air duct assembly is detached from the air conditioner.

As shown in FIG. 6, in an embodiment, the axial hole 114 passes through the first shaft section 111 and the second shaft section 112. The fan blade shaft 11 in the above setting is small in mass.

As shown in FIG. 2, FIG. 3 and FIG. 6, in an embodiment, the fan blade shaft 11 is further provided with a radial hole 115 communicated with the axial hole 114, the air duct assembly further includes a locking part 40, the locking part 40 is abutted against the motor shaft after passing through the radial hole 115, so as to enable the motor shaft to be locked on the fan blade shaft 11.

In some embodiments, the locking part 40 is extended into the axial hole 114 after passing through the radial hole 115, and is abutted against the outer wall surface of the motor shaft, in this way, the motor shaft drives the fan blade shaft 11 to be rotated. In the above setting, the motor shaft and the fan blade shaft 11 are simple in structure, and it is convenient to achieve.

As shown in FIG. 6, in the some embodiments, the radial hole 115 is disposed in the second shaft section 112, the above setting is capable of shortening a length of the motor shaft. Through the above setting, because the radial hole 115 is installed close to the drive portion 50, it is convenient to install the locking part 40, so the motor shaft is conveniently locked on the fan blade shaft 11.

In an embodiment, the radial hole 115 is a threaded hole, and the locking part 40 is a screw. The screw is extended into the axial hole 114 after screwing out of the threaded hole, and abutted against the outer wall surface of the motor shaft, that is, the motor shaft and the fan blade shaft 11 are connected, and the operation is simple.

In some embodiments, the outer wall surface of the motor shaft is provided with a plane parallel to the axis thereof, the screw is abutted against the plane, a contact area of the screw and the plane is large, the screw is abutted better against the outer wall surface of the motor shaft, and a phenomenon that the screw slides on the outer wall surface of the motor shaft is avoided.

As shown in FIG. 1 to FIG. 4, some embodiments of the present disclosure provide an air conditioner. The air conditioner of some embodiments includes a housing and an air duct assembly installed in the housing, the air duct assembly is the above air duct assembly.

In an embodiment, one end, away from the fan blade shaft 11, of the fan blade 10 is provided with a rotating shaft; one end, away from the drive portion 50, of the installing base 70 is provided with a first installing hole; and the air duct assembly further includes an installing shaft sleeve 60 which is disposed in the first installing hole and fixedly connected with the installing base 70, the installing shaft sleeve 60 is provided with a second installing hole corresponding to the rotating shaft, one end, away from the fan blade shaft 11, of the rotating shaft is inserted into the second installing hole, the rotating shaft is moveably provided in an axis of the second installing hole of the installing shaft sleeve 60 relative to the installing base 70. In the air duct assembly in the above setting, whether the fan blade shaft 11 is in the first position or the second position, the fan blade 10 is always supported by the installing shaft sleeve 60 and the fan blade support assembly positioned at two ends of the fan blade 10 together. The above setting guarantees that a position of the axis of the fan blade shaft 11 of the fan blade 10 is not changed relative to the installing base 70, thereby it is guaranteed that the fan blade shaft 11 of the fan blade 10 has the same axis as the motor shaft of the drive portion 50 while the air duct assembly is detached from the air conditioner, or the air duct assembly is assembled in the air conditioner. Therefore, while the air duct assembly is installed in the air conditioner, the fan blade 10 is directly moved towards the drive portion 50, that is, butting connection of the motor shaft and the fan blade shaft 11 is achieved, and then the screw is tightened, so the connection of the motor shaft and fan blade shaft 11 is completed. The coaxiality of the fan blade shaft 11 and the motor shaft is not required to be corrected by a professional tool during a whole installing process.

An embodiment of the present disclosure is applied during the production installation and after-sale detaching of the air duct assembly for maintenance or clean. While the air duct assembly is installed in the air conditioner, after the installing base 70 is installed in the air conditioner, a motor is installed on a motor base of the air conditioner; at this moment, because the position in which the axis of the fan blade shaft is positioned is not changed relative to the position before detaching, the fan blade shaft 11 is moved from the second position to the first position, that is, the fan blade shaft 11 is rapidly abutted to the motor shaft, the operation is convenient, and it is guaranteed that the fan blade shaft 11 is also rapidly abutted to the motor shaft in the case that internal space of the air conditioner is invisible; and while the air duct assembly is detached, a screw on the fan blade shaft 11 is detached by a screw driver, and then the fan blade 10 is prodded manually at an air outlet of the air conditioner, so the fan blade shaft 11 is moved from the first position to the second position, that is, the fan blade shaft 11 is disconnected with the motor shaft, and the whole air duct assembly is detached from the air conditioner. The above operation of enabling the air duct assembly to be detached from the air conditioner is rapid, and convenient.

In preconditions of ensuring the overall safety and reliable operation, some embodiments of the present disclosure have the following advantages: after the air duct assembly is assembled in the air conditioner, it has the good coaxiality between the fan blade shaft 11 and the motor shaft, the shaft runout caused by poor coaxiality between the fan blade shaft 11 and the motor shaft is avoided while the air conditioner is in operation, and the overall performance and service life are affected. The air conditioner of the present disclosure is capable of rapidly detaching and installing the air duct assembly, that is, it is achieved that the air duct assembly is rapidly detached from the air conditioner or the air duct assembly is rapidly assembled in the air conditioner, and a modularized design of the air conditioner is satisfied.

Embodiment 2

A difference between embodiment 1 and embodiment 2 is that, in the embodiment 2, while the fan blade shaft 11 is positioned in the second position, the transition section 113 is abutted against the inner wall surface of the shaft hole 21.

In embodiment 2, the fan blade shaft 11 further includes the transition section 113 disposed between the first shaft section 111 and the second shaft section 112, from the first shaft section 111 to the second shaft section 112, the outer diameter of the transition section 113 is gradually increased, the fan blade shaft 11 is provided with the first position and the second position, when the fan blade shaft 11 is positioned in the first position, there is a gap between the outer wall surface of the first shaft section 111 and the inner wall surface of the shaft hole 21; and when the fan blade shaft 11 is positioned in the second position, the transition section 113 is abutted against the inner wall surface of the shaft hole 21.

In embodiment 2, in the process of switching the fan blade shaft 11 from the first position to the second position, the transition section 113 has the above effect of automatic centering and correcting; and in addition, when the fan blade shaft 11 is positioned in the second position, the transition section 113 of the fan blade shaft 11 is supported by the support structure 20, in this way, when the fan blade shaft 11 is positioned in the second position, the fan blade shaft 11 can not be moved along the radial direction of the shaft hole 21 relative to the support base 30.

Other structures in embodiment 2 are the same as embodiment 1, and are not repeatedly described here.

It can be seen from the above description that the above embodiment of the present disclosure achieves the following technical effects: the fan blade support assembly is applied to the air duct assembly of the air conditioner. While the fan blade shaft is connected with the drive portion, the first shaft section of the fan blade shaft is installed in the shaft hole of the support structure; because the diameter of the first shaft section is less than that of the second shaft section, and the fan blade shaft is moveably installed relative to the support base, while the fan blade shaft is connected with the drive portion, there is a gap between the outer wall surface of the first shaft section of the fan blade shaft and the inner wall surface of the shaft hole of the support structure, in this way, while the drive portion drives the fan blade shaft to be rotated, the mutual friction or collision, caused by tiny shaft runout, between the outer wall surface of the fan blade shaft and the inner wall surface of the shaft hole of the support structure can be avoided, thereby the noise is reduced, and the problem in the art known to inventors that the abnormal sound and noise are caused by the friction or collision between the fan blade shaft and the support structure is solved. In addition, the fan blade support assembly in the above setting can prevent the fan blade shaft from being worn.

The above are only some embodiments of the present disclosure, and are not intended to limit the present disclosure. For those skilled in the air, the present disclosure has various modifications and changes. Any modifications, equivalent replacements, improvements and the like made within the spirit and principles of the present disclosure shall be included in a scope of protection of the present disclosure.

What is claimed is:

1. A fan blade support assembly for a fan blade, wherein the fan blade support assembly comprises:

a support base, wherein the support base comprises a support base body, and the support base body is provided with a support base hole;

a support structure, provided in the support base hole, and the support structure is provided with a shaft hole; and a fan blade shaft, wherein, an end of the fan blade shaft is connected with a drive portion after passing through the shaft hole, and the fan blade shaft is movably provided relative to the support base, wherein, the fan blade shaft comprises a first shaft section and a second shaft section connected with the first shaft section, and a diameter of the first shaft section is less than a diameter of the second shaft section;

wherein the fan blade shaft is provided with a first position which can be driven by the drive portion and a second position separated from the drive portion, while the fan blade shaft is positioned in the first position, there is a gap between an outer wall surface of the first shaft section and an inner wall surface of the shaft hole, and when the fan blade shaft is positioned in the second position, the second shaft section is abutted against the inner wall surface of the shaft hole.

2. The fan blade support assembly as claimed in claim 1, wherein the fan blade shaft further comprises a transition section disposed between the first shaft section and the second shaft section, from the first shaft section to the second shaft section, an outer diameter of the transition section is gradually increased.

3. The fan blade support assembly as claimed in claim 2, wherein the support structure is a sleeve provided at an outer circumference of the fan blade shaft in a sleeving manner, an internal through hole of the sleeve forms the shaft hole, and the sleeve is an elastic part.

4. The fan blade support assembly as claimed in claim 1, wherein the support structure is a sleeve provided at an outer circumference of the fan blade shaft in a sleeving manner, an internal through hole of the sleeve forms the shaft hole, and the sleeve is an elastic part.

5. An air duct assembly, the air duct assembly comprises an installing base, wherein the air duct assembly further comprises the fan blade support assembly as claimed in claim 1, wherein, the fan blade support assembly is installed on the installing base and a fan blade is connected with the fan blade shaft.

6. The air duct assembly as claimed in claim 5, wherein the fan blade shaft is provided with an axial hole, a motor shaft of the drive portion is inserted into the axial hole, so as to connect the drive portion and the fan blade shaft.

7. The air duct assembly as claimed in claim 6, wherein the axial hole passes through the first shaft section and the second shaft section.

8. The air duct assembly as claimed in claim 6, wherein the fan blade shaft is further provided with a radial hole communicated with the axial hole, the air duct assembly further comprises a locking part, the locking part passes through the radial hole and abuts against the motor shaft, so that the motor shaft is locked on the fan blade shaft.

9. The air duct assembly as claimed in claim 8, wherein the radial hole is disposed in the second shaft section.

10. An air conditioner, comprising a housing and the air duct assembly as claimed in claim 5, wherein the air duct assembly is installed in the housing.

11. The air duct assembly as claimed in claim 5, wherein the fan blade shaft further comprises a transition section disposed between the first shaft section and the second shaft section, from the first shaft section to the second shaft section, an outer diameter of the transition section is gradually increased.

12. The air duct assembly as claimed in claim 5, wherein the support structure is a sleeve provided at an outer circumference of the fan blade shaft in a sleeving manner, an internal through hole of the sleeve forms the shaft hole, and the sleeve is an elastic part.

13. A fan support assembly for a fan blade, wherein the fan blade support assembly comprises:

a support base, wherein the support base comprises a support base body, and the support base body is provided with a support base hole;

a support structure, provided in the support base hole, and the support structure is provided with a shaft hole; and a fan blade shaft, wherein, an end of the fan blade shaft is connected with a drive portion after passing through the shaft hole, and the fan blade shaft is movably provided relative to the support base, wherein, the fan blade shaft comprises a first shaft section and a second shaft section connected with the first shaft section, and a diameter of the first shaft section is less than a diameter of the second shaft section, wherein the fan blade shaft further comprises a transition section disposed between the first shaft section and the second shaft section, from the first shaft section to the second shaft section, an outer diameter of the transition section is gradually increased, the fan blade shaft is provided with a first position and a second position, when the fan blade shaft is positioned in the first position, there is a gap between an outer wall surface of the first shaft section and an inner wall surface of the shaft hole; and when the fan blade shaft is positioned in the second position, the transition section is abutted against the inner wall surface of the shaft hole.

14. The fan blade support assembly as claimed in claim 13, wherein the support structure is a sleeve provided at an outer circumference of the fan blade shaft in a sleeving manner, an internal through hole of the sleeve forms the shaft hole, and the sleeve is an elastic part.

15. An air duct assembly, the air duct assembly comprises an installing base, wherein the air duct assembly further comprises the fan blade support assembly as claimed in claim 13, wherein, the fan blade support assembly is installed on the installing base and a fan blade is connected with the fan blade shaft.

16. The air duct assembly as claimed in claim 15, wherein the fan blade shaft is provided with an axial hole, a motor shaft of the drive portion is inserted into the axial hole, so as to connect the drive portion and the fan blade shaft.

* * * * *